US005553572A

United States Patent [19]

Ochiai

[11] Patent Number: 5,553,572

[45] Date of Patent: Sep. 10, 1996

[54] MULTI-VALVE ENGINE

[75] Inventor: Katsumi Ochiai, Iwata, Japan

[73] Assignees: Sony Corporation, Tokyo, Japan; Materials Research Corporation, Orangeburg, N.Y.

[21] Appl. No.: 316,249

[22] Filed: Sep. 30, 1994

[30] Foreign Application Priority Data

Sep. 30, 1993 [JP] Japan ..... 5-244990

[51] Int. Cl.[6] ..... F01L 1/24; F01L 9/02; F02B 1/00

[52] U.S. Cl. ..... 123/90.14; 123/90.27; 123/90.65; 123/193.3

[58] Field of Search ..... 123/90.14, 90.27, 123/90.65, 90.66, 90.67, 193.5, 193.3

[56] References Cited

U.S. PATENT DOCUMENTS

| | | | |
|---|---|---|---|
| 3,120,221 | 2/1964 | Lyons | 123/90.14 |
| 4,592,313 | 6/1986 | Speckhart | 123/90.65 |
| 4,915,065 | 4/1990 | Yamada | 123/90.27 |
| 5,058,541 | 10/1991 | Shibata et al. | 123/90.65 |
| 5,233,950 | 8/1993 | Umemoto et al. | 123/90.14 |

FOREIGN PATENT DOCUMENTS

| | | | |
|---|---|---|---|
| 0536513 | 4/1993 | European Pat. Off. . | |
| 2529616 | 1/1984 | France | 123/90.14 |
| 230909 | 9/1990 | Japan | 123/90.14 |
| 283809 | 11/1990 | Japan | 123/90.14 |

OTHER PUBLICATIONS

Patent Abstracts of Japan, vol. 14 No. 545 (M-1054) 4 Dec. 1990 & JP-A-02 230909 (Honda Motor Co Ltd) 13 Sep. 1990.

*Primary Examiner*—Weilun Lo

*Attorney, Agent, or Firm*—Pasquale Musacchio; Jerry A. Miller

[57] ABSTRACT

An improved air spring arrangement for an internal combustion engine having three valves per cylinder which are disposed in surrounding relationship to a spark plug. The air spring arrangement is formed by a recess formed in the cylinder head that encompasses each of the valve stems and an insert piece that is inserted into this recess and which defines the bores for the respective air chambers. The supply and relief passages for the air chambers are formed in the insert piece by drilled passages which have a V-shaped configuration to provide a more compact assembly and a less complicated cylinder head arrangement.

29 Claims, 7 Drawing Sheets

MULTI-VALVE ENGINE

BACKGROUND OF THE INVENTION

This invention writes to a multi-valve engine and more particularly to an improved air spring arrangement for an engine having at least three valves serving the same cylinder of the engine.

Conventionally, the poppet valves of an internal combustion engine are closed by one or more mechanical springs that are interposed between the stem of the valve and the cylinder head. Normally coil springs are utilized for this purpose. In order to achieve high engine speeds, it has been proposed to use a pair of concentric springs to increase the closing force.

There are several disadvantages to utilizing such mechanical springs. In the first instance, the spring may set up a harmonic action that can cause the valve to not seat properly or appropriately. In addition, the mechanical springs add weight to the engine and both of these features tend to reduce the potential output of the engine by limiting the speed at which the engine can be operated.

Therefore, there have been proposed arrangements that employ an air spring for urging the valves to their closed positions. These air springs generally define a pneumatic chamber that encircles the valve stem and in which a piston is slidably supported and biased by the air pressure in the chamber. This piston is connected to the stem of the valve so that the air pressure will urge the valve to its closed position.

With these arrangements it is the normal practice to employ a pair of air lines and valves that communicate with the pneumatic chambers for supplying air under pressure to them and for controlling the air pressure in the chambers. This obviously requires the formation of appropriate supply and discharge passages in the cylinder head or the member in which the air pressure cylinders are formed.

Although this provision of supply and discharge conduits presents a relatively easily solved problem when utilizing four valve per cylinder cylinder heads, greater problems arise when using a greater number of valves. When four valve per cylinder engines are employed, it is the general practice to have a pair of intake valves on one side of the combustion chamber and a pair of exhaust valves on the other side of the combustion chamber. The respective intake and exhaust valves have their reciprocal axes lying in common planes. This placement permits the use of one drilled passageway that can extend longitudinally through either the cylinder head or the cam carrier, depending upon which member forms the pneumatic cylinders.

Where it is proposed to employ three valves, either for the intake or exhaust valves or both, however, the valve stem axes all do not lie in a common plane. With the use of three valves per cylinder for either the intake or exhaust function, the valve stems are disposed in encircling relationship to the spark plug which is centrally positioned in the combustion chamber. Although the valves may be put in line, then the spark plug must be offset or otherwise disposed so that it will not be in its optimum position.

The use of the varying angular positions for the stems of the three valves also permits the formation of a relatively small combustion chamber having a relatively small surface area that permits high compression ratios and low quenching. With such a valve placement, however, it is then difficult to provide supply passages and discharge passages for delivering and relieving the air from the pneumatic cylinders which are also arrayed in a somewhat circular fashion around the spark plug.

It is, therefore, a principal object of this invention to provide an improved and simplified air spring arrangement for an engine having at least three intake and/or exhaust valves per cylinder.

It is a further object of this invention to provide an improved air spring arrangement for a three valve engine that facilitates the formation of supply and relief passages without interfering with the other components of the cylinder head.

As has been noted, it has been previously the practice to form the air chamber for the air spring in either the cylinder head or in a cam carrier that also journals the camshaft and actuating tappets for the valves. With this arrangement, the formation of the passages and their necessary bores for the pneumatic cylinders can present substantial problems. In addition, the assembly and alignment of all of the components can be difficult.

It is, therefore, a further object of this invention to provide an improved cylinder head assembly for an engine having pneumatically closed valves.

It is a further object of this invention to provide a cylinder head assembly having individual inserts that form at least portions of the pneumatic spring arrangement for closing the valves of the engine, so that the passages therefor can be easily formed and independently of the cylinder head and/or cam carrier.

SUMMARY OF THE INVENTION

A first feature of this invention is adapted to be embodied in an air spring arrangement for the cylinder head assembly of an internal combustion engine having a spark plug placed in the cylinder head generally centrally in the combustion chamber. At least three poppet-type valves are supported for reciprocation within the cylinder head assembly in surrounding relationship to the spark plug. At least three air chambers are formed in the cylinder head assembly, each of which communicates at least in part with a stem of a respective one of the poppet valves. A V-shaped air passage is formed in the cylinder head assembly between the spark plug and the air chambers and communicates with the air chambers.

Another feature of the invention is adapted to be embodied in a cylinder head assembly for an engine comprising a cylinder head defining a combustion chamber and supporting a plurality of poppet valves for reciprocation to control the flow for the combustion chamber. A cam carrier is affixed to the cylinder head and rotatably journals a camshaft for operating the valves and a plurality of tappets, each cooperating with a respective one of the valves for operating the valves. In accordance with the invention, one of the cylinder head and cam carrier is formed with a recess adapted to receive a cylinder head insert that forms a plurality of pneumatic chambers, each of which is associated with a respective one of the poppet valve stems for urging the poppet valves to their closed position. This insert piece is retained in an area between the cylinder head and the cam carrier.

DETAILED DESCRIPTION OF THE PREFERRED EMBODIMENTS

Figure 1:
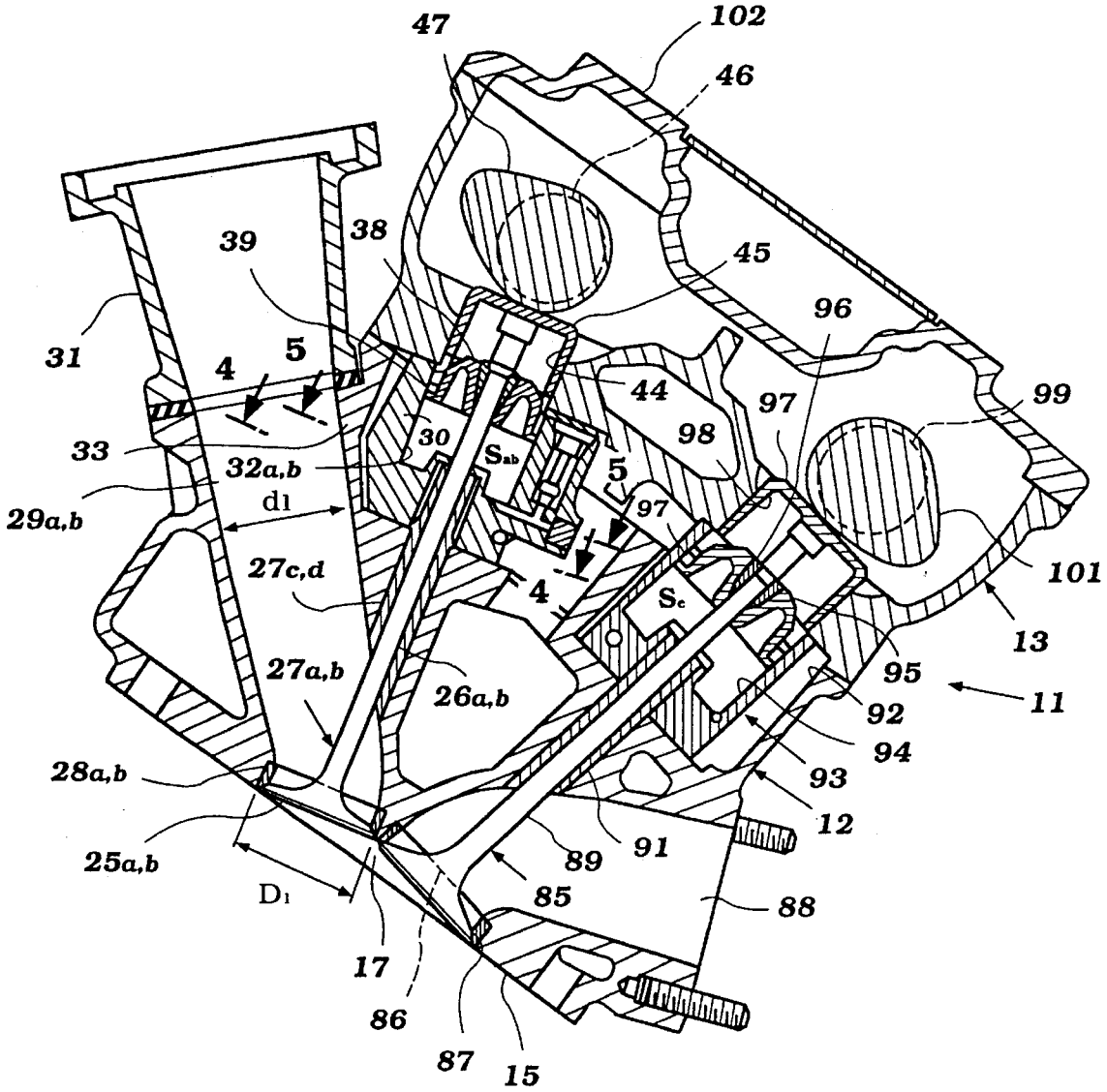
FIG. 1 is a cross-sectional view taken through a cylinder head assembly constructed in accordance with an embodiment of the invention. The view passes through one of the side intake valves and one of the exhaust valves and shows the head in the orientation in which it is mounted in the engine.

Referring now in detail to the drawings, a cylinder head assembly of an internal combustion engine constructed in accordance with an embodiment of the invention is shown in cross-sectional views and is indicated generally by the reference numeral 11. Only a cross-section through a single cylinder of the engine is depicted because it is believed that those skilled in the art can readily understand how the invention is applied to multiple cylinder engines.

Figure 2:
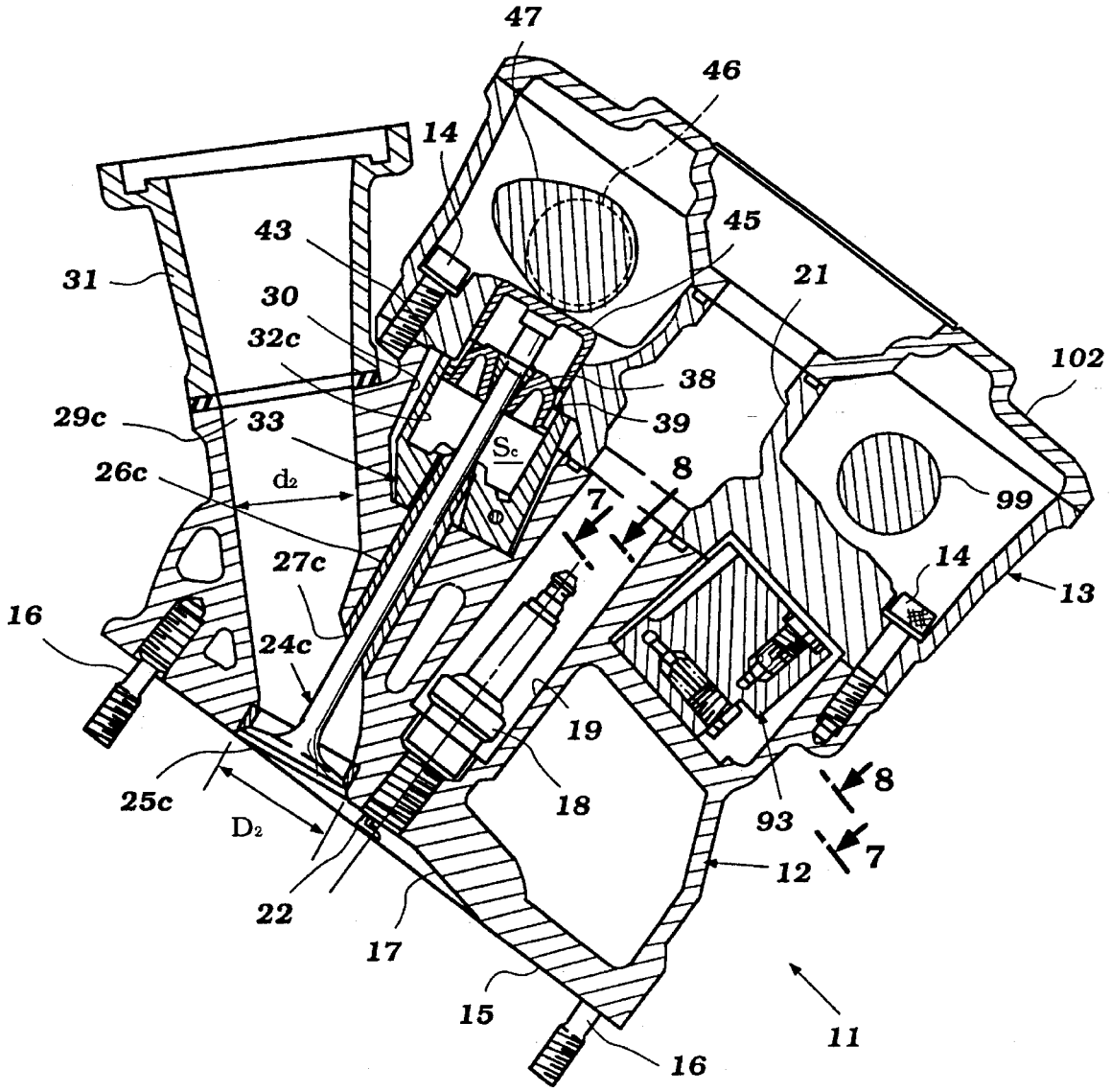
FIG. 2 is a cross-sectional view, in part similar to FIG. 1, and is taken along a plane parallel to the plane of FIG. 1, but which passes through the center of the combustion chamber.
Figure 3:
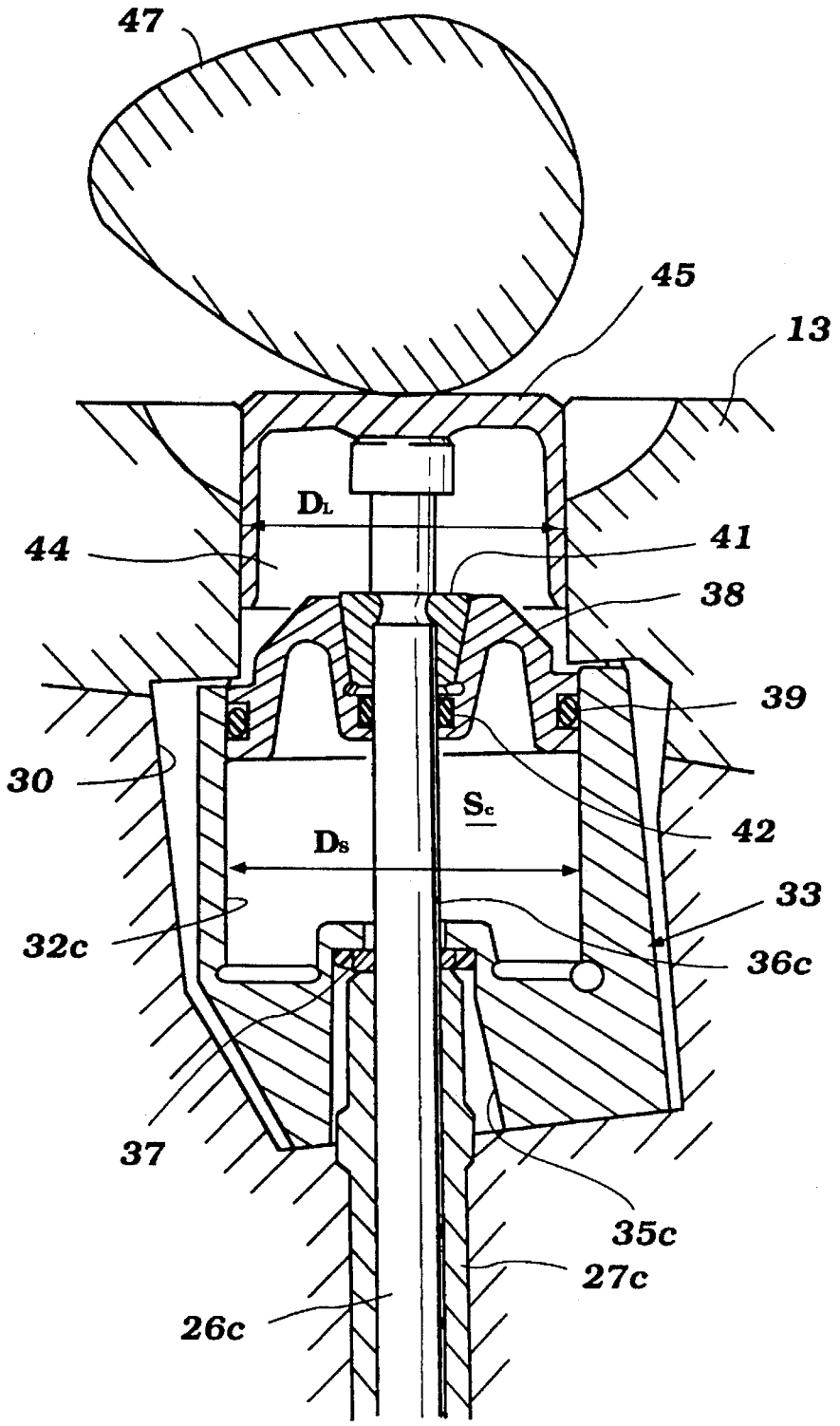
FIG. 3 is an enlarged cross-sectional view showing the pneumatic valve system and its association with the poppet valve and camshaft, this being that of the center intake valve as shown in FIG. 2. This view is taken along the same plane as FIG. 2.

In the illustrated embodiment, the cylinder head 11 is depicted in FIGS. 1 and 2 in its orientation on one cylinder bank of a V-type engine. Thus orientation is a preferred orientation, but it will be obvious to those skilled in the art that the invention may be employed with in-line engines and engines wherein the cylinder banks are opposed.

The cylinder head assembly 11 is comprised of two main components, each of which may be formed as a casting from a lightweight material such as aluminum or aluminum alloys. These comprise a cylinder head member 12 and a cam carrier member 13, with the cam carrier member 13 being affixed to the cylinder head member 12 by means including a plurality of socket-headed fasteners 14.

The cylinder head member 12 has a lower surface 15 that is adapted to be brought into sealing engagement with a corresponding surface of a cylinder block (not shown) and is affixed thereto by means including threaded fasteners 16. The area of the cylinder head surface 15 overlying the individual cylinder bores of the cylinder block is provided with a relatively shallow recess 17 which forms in part the combustion chamber.

The associated cylinder bore is generally cylindrical and has an axis L on which a spark plug 18 is mounted in the cylinder head. The spark plug 18 is mounted in a well 19 formed centrally in the cylinder head member 12 and which is accessible through a corresponding well 21 formed in the cam carrier member 13. Although other spark plug locations may be chosen, the particular central position is particularly useful and permits a single spark plug 18 to be disposed with its spark gap 22 disposed at the center of the combustion chamber.

The cylinder head assembly 11 is provided with three intake valves per cylinder, indicated generally by the reference number 24. The values 24 are comprised of a pair of side intake valves 24*a* and 24*b* and a center intake valve 24*c*. The intake valves 24*a*, 24*b* and 24*c* are disposed in the cylinder head 11 in a configuration as generally described in U.S. Pat. No. 4,660,529, entitled "Four-Cycle Engine," issued Apr. 28, 1987 and assigned to the assignee hereof, which patent has been reissued as U.S. Pat. No. Re. 33,787 on Jan. 7, 1992.

Specifically, the side intake valves 24*a* and 24*b* have head portions 25*a* and 25*b* which are disposed so that they lie partially on one side of a plane containing the axis of the cylinder bore L, which plane contains the axis of rotation of the crankshaft of the engine and extends perpendicularly to the planes of FIGS. 1 and 2. The bulk of the valve heads 25*a* and 25*b*, however, lie on the other side of this plane. The head 25*c* of the center intake valve 24*c* is disposed further from this plane and lies completely on the other side of the plane.

The valves 24 have stem portions 26 that are supported for reciprocation in the cylinder head 12 by means of pressed or cast-in valve guides 27. The side intake valves 24*a* and 24*b* have their axes of reciprocation lying in a common plane that is disposed at an acute angle to the aforenoted plane containing the cylinder bore axis L. The center intake valve 24*c* has its reciprocal axis disposed also at an acute angle to this plane, but this acute angle is less then the acute angle of the plane containing the axes of reciprocation of the side intake valves 24*a* and 24*b*.

This configuration for the intake valves 24 and placement permits the use of a very small combustion chamber recess 17 in the cylinder head and a resulting high compression ratio. In addition, the placement also permits the recess 17 to have a relatively small surface area and thus quenching of the charge is substantially reduced.

The intake valves 24 and specifically their heads 25 control the flow through respective valve seats 28 formed at the termination of respective intake passages 29 formed in the cylinder head 12 on the side of the plane where the heads of the valves 24 lie. A suitable charge is provided to the combustion chambers through these intake passages 29 and this charge may be supplied by a fuel injection system, as will be described later by reference to FIG. 10 through trumpets 31 in which slide or butterfly-type throttle valves (not shown) may be provided.

The configuration illustrated in this embodiment employs a smaller diameter $D_2$ for the center intake valve 24*c* than the diameter $D_1$ of the side intake valves 24*a* and 24*b*. The diameters $D_2$ and $D_1$ of the intake passages 29*c* and 29*a* and 29*b* may be varied proportionately so as to obtain the desired tuning affect for the induction system.

The valve stems 26 extend upwardly through the body of the cylinder head 12 and pass through an enlarged recess 30 which is common for the intake valves 24 of each cylinder. That is, the cylinder head 12 is provided with a recess 30 associated with each cylinder of the engine 11. Contained within this recess is a pneumatic spring forming member, indicated generally by the reference numeral 33. This member 33 is formed with three bores 32 that define in part pneumatic chambers, each indicated by the reference character S. The chambers for the side valves 24*a* and 24*b* are indicated as $S_a$ and $S_b$ and the chamber for the center intake valve 24*c* indicated at $S_c$. The cross-sectional area of the recesses may be proportioned to the diameter or weight of the respective valve which they are associated with.

The pneumatic chamber forming insert 33 is provided with a pair of counterbored openings (FIG. 6) that have a first diameter portion 35*a* or 35*b* that is complimentary to the external diameter of the valve guides 27*a* and 27*b* and a smaller diameter portion 36*a* and 36*b*, which is complimentary to the diameter of the stems 26*a* and 26*b* of the side intake valves.

The area of the insert piece 33 associated with the center intake valve 24*c* is provided with a counterbore comprised of a lower, larger diameter portion 35*c*, which diameter 35*c* is larger than the diameter of the center valve guide 27*c* so as to provide clearance for insertion. This is necessary because the angle of the valve guide 27*c* is different from that of the intake valve guides 27*a* and 27*b*. The counterbore also has a portion 36*c* which is larger in diameter than the valve stem 26*c* for the same reason.

Appropriate O-ring seals 37 are placed around the valve stems 36 and are engaged around the insert bores 36 so as to provide airtight sealing for the chambers S.

A piston 38 is slidably supported within each of the bores 32 of the insert piece 33. These pistons 38 have skirts that are provided with grooves in which O-ring seals 39 are received so as to provide a seal with the bore 32 so that the chambers S are substantially airtight. A keeper retainer assembly 41 of the split type retains each piston 38 on the valve stem 26 at the appropriate location. A further seal 41 is provided between the lower end of the piston 38 and the valve stem 26 so as to further ensure tight sealing of the chambers S. Each chambers S is pressurized with air under pressure, in a manner which will be described later.

The cam carrier 13 is provided with recesses 43 in its lower face which are complimentary to and which engages the upper side of the insert 33 so as to fix it in location in the cylinder head recess 30.

The cam carrier 13 is provided with three bores 44, each of which receives a thimble tappet 45 that is engaged with the upper end of the respective valve stem 26. An intake cam shaft, indicated generally by the reference numeral 46, is journaled suitably within the cam carrier 13, as by bearing caps (not shown) and has cam lobes 47 that engage the thimble tappets 45 for opening the respective intake valves 24.

It should be noted that the diameter $D_L$ of the thimble tappets 45 is smaller than the diameter $D_s$ of the bores 32 of the air pressure chambers $S_c$. In addition, the tappet 45 is in sliding engagement with the cam carrier 13 while the piston 38 is in sliding engagement with the material of the insert piece 33. The materials of the cam carrier 13 and the insert piece 33 may be the same or different, but are preferably formed from a lightweight material. In addition, the bores 32 of the insert piece 33 may be formed with a surface treatment such as anodizing if they are aluminum, and/or plating with chromium or nickel or alloys thereof so as to improve the sealing arrangement and the slidability of the piston 33 therein.

Figure 4:
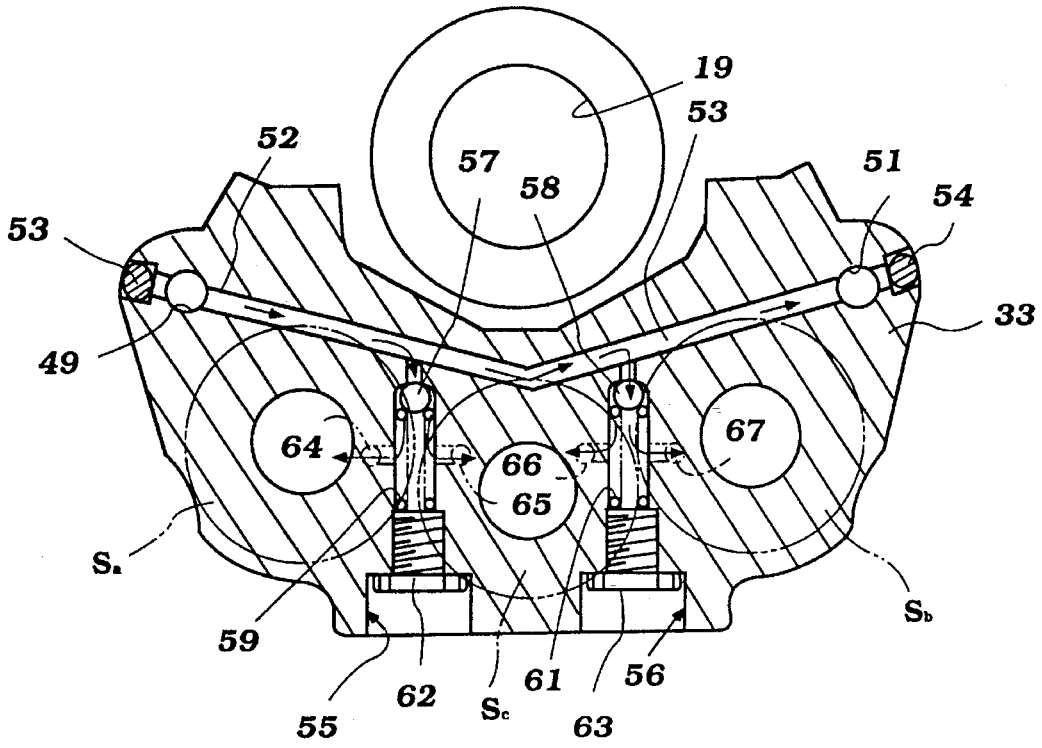
FIG. 4 is an enlarged cross-sectional view taken along the line 4—4 of FIG. 1.

The system for pressurizing the chambers S and maintaining the pressure therein will now be described by reference to FIGS. 4–6. FIG. 4 shows the arrangement wherein air pressure is delivered to the bores 32 of the chambers S. This system includes a pair of vertical drillings 49 and 51, one of which, the drilling 49 in FIG. 4, is exposed to air pressure from an air compressor in a circuit which may include a regulator. This air pressure conduit 49 can communicate with a suitable supply conduit drilled or otherwise formed in the cylinder head 12. The remaining conduit 51 may be connected to the inlet conduit 49 of an adjacent insert piece 33 for another cylinder or with the exhaust side, as will be described.

A pair of drillings 52 and 53 extend perpendicularly to the drillings 49 and 51 and have their outer ends closed by respective plugs 53 and 54. The drillings 52 and 53 are disposed at a V-angle to each other, as readily seen in FIG. 4. This permits the insert piece 33 to be shaped in a generally V-shaped fashion so as to nest around the spark plug well 19 as shown in this figure.

The insert piece 33 is provided with a pair of counterbored passages, indicated generally by the reference numerals 55 and 56, which extend between the chambers Sa and Sc, and Sc and Sb, respectively, but which pass below them. Ball type check valves 57 and 58 normally close a small diameter portion of the counterbores 55 and 56 that communicates with the drilled passages 52 and 53, respectively. These check valves 57 and 58 are urged toward their closed positions by respective coil springs 59 and 61 which are loaded by adjustable screw-type stops 62 and 63 so as to set the pressure at which the ball type check valves 57 and 58 open.

The counterbore 55 is intersected downstream of the ball type check valve 57 by a pair of passages 64 and 65 which are drilled through the base of the air cylinder bores 32*a* and 32*c*, respectively. In a like manner, a pair of drilled passages 66 and 67 extend from the base of the bores 32*c* and 32*b* and intersect the counterbored passage 56.

When air under pressure is supplied to the drillings 52 and 53, the ball check valves 57 and 58 will open and charge the chambers $S_a$, $S_c$ and $S_b$ with air under pressure. This air under pressure is then trapped in the chambers $S_a$, $S_c$ and $S_b$ and will act to urge the respective intake valves 24 to their closed positions. It should be noted that the flow arrangement to the chambers $S_a$, $S_c$ and $S_b$ is designed so as to ensure that the pressure in each chamber will be maintained substantially the same and that easy charging is accomplished.

Figure 5:
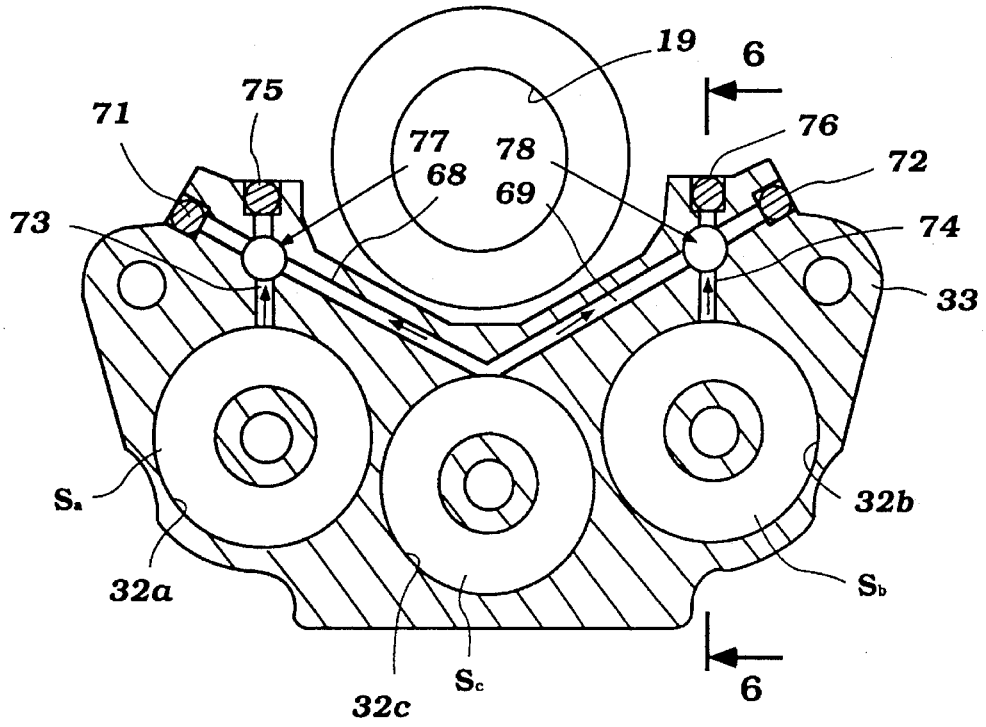
FIG. 5 is an enlarged cross-sectional view taken along the line 5—5 of FIG. 1.
Figure 6:
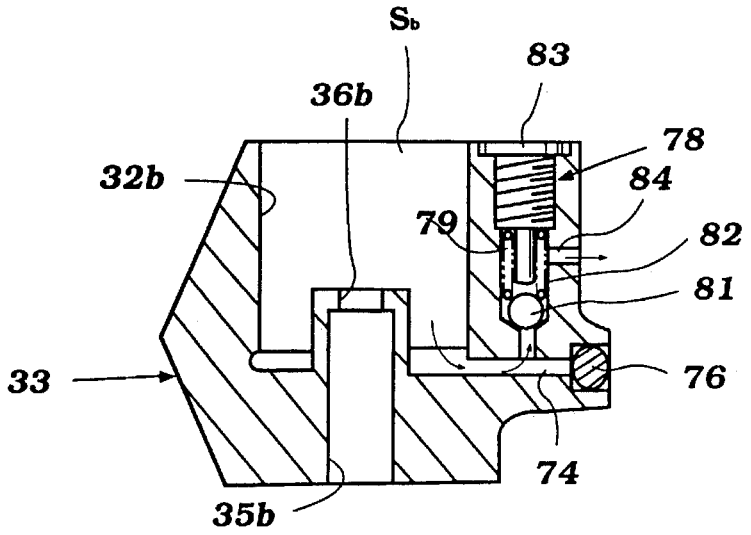
FIG. 6 is an enlarged cross-sectional view taken along the line 6—6 of FIG. 5.

The maximum pressure in each of the chambers Sa, Sb and Sc is controlled by a relief valve arrangement, as shown in FIGS. 5 and 6. This relief valve arrangement includes a pair of cross-drilled passages 68 and 69, which have a generally V-shaped configuration but of a narrower V angle than the supply passages 52 and 53. The outer ends of these drillings 68 and 69 are closed by plugs 71 and 72, and the passages 68 and 69 intersect the bore 32*c* of the center valve pressure chamber $S_c$. Cross drillings 73 and 74 intersect the drillings 68 and 69, and bores 32*a* and 32*b*, respectively. These drilled passages 73 and 74 are closed by closure plugs 75 and 76.

Pressure-responsive valve assemblies, indicated generally by the reference numerals 77 and 78, are provided at the intersection between the drillings 68 and 73, and 69 and 74, respectively. These valves 77 and 78 control the maximum pressure which can exist in the chambers $S_a$, $S_b$ and $S_c$, and each has a construction as shown in FIG. 6.

The pressure relief valves include a counterdrilled passageway 79 that intersects the respective drillings 73 and 74. A ball type check valve 81 controls the flow through the smallest diameter portion of these counterbores which intersects the passages 73 and 74. The ball type check valve 81 is loaded by a coil compression spring 82 which has engagement with an adjusting screw 83 so as to set the pressure at which the ball type check valve 81 opens. This controls the maximum pressure that can exist in the chambers $S_a$, $S_b$ and $S_c$, which maximum pressure exists when the associated valve 24 is fully open.

If this pressure is exceeded, the ball check valve 81 will open, as shown by the arrows in FIG. 6, and the excess pressure is relieved to the atmosphere through a bleed port 84 that intersects the portion of the counterbore in which the spring 79 is captured. This pressure is discharged to the atmosphere.

It should be readily apparent that the described construction utilizing the insert piece 33 permits the provision of three pressure chambers for the air springs of three valves associated with the same cylinder of the engine. By using the separate insert piece and the V-shaped cross drillings for supply and discharge passages, the construction can be quite compact and eliminates very complex drilling and machining operations in the cylinder head or cam carrier itself.

The exhaust side of the cylinder head assembly 11 will now be described by initial reference again to FIGS. 1 and 2. It has been noted that the intake valves 24 have their head portions 25 lying substantially on one side of a plane that contains the cylinder bore axis L and which extends generally perpendicularly to the plane of FIGS. 1 and 2. This plane also encompasses the axis of rotation of the crankshaft for the engine. The exhaust system lies on the other side of this plane and this includes a pair of exhaust valves, each indicated generally by the reference numeral 85. The exhaust valves 85 have head portions 86 that control the flow through valve seats 87 that are formed at the inlet ends of exhaust ports 88 that extend through the side of the cylinder head 12 opposite the intake passages 29.

The exhaust valves 85 have stem portions 89 that are supported for reciprocation within valve guides 91 that are pressed or cast into the cylinder head 12. The axes of reciprocation of the exhaust valves 85 defined by the valve guides 91 lie in a common plane that is disposed at an acute angle to the aforenoted plane containing the cylinder bore axis L. This acute angle is, as described in the aforenoted United States Letters Patent, disposed at a lesser acute angle to this plane than the side intake valves 24*a* and 24*b* and a greater angle than that of the center intake valve 24*c*. Again, this construction permits a compact combustion chamber volume, a low surface area for the recess 17, and high compression ratios.

The exhaust valve stems 89 extend through a recess 92 formed in the cylinder head 12 similar to the recess 30 and in which an insert piece 93 is received. The insert piece forms an air springs for holding the exhaust valves 85 in their closed position. These air springs are comprised of a pair of bores 94 that extend parallel to the axis of reciprocation of the exhaust valves 85 and which receive pistons 95 that are affixed to the exhaust valve stems 89 by keeper retainer assemblies 96. The pistons 95 have seals 97 that are slidably engaged with the bores 94 and which define exhaust valve air pressure chambers $S_e$. These chambers are pressurized in a manner which will be described.

As with the intake valve insert 33, the exhaust valve insert 93 is retained in the recess 92 by engagement with the cam carrier 13. Since the valve stems 89 of the exhaust valves 85 extend parallel to each other, counterbored portions complementary in diameter to the guides 95 and stems 89 provide the sealing arrangement at the lower end, which is the same as that previously described, and therefore its description will not be repeated. In a like manner, the pistons 95 are sealed to the valve stems 89 so that the exhaust air spring chambers $S_e$ are effectively sealed.

The materials employed with the pistons 95 and the bores 94 may be the same or similar to those as described in conjunction with the intake valve air spring arrangement provided by the insert piece 33.

Thimble-type tappets 97 are slidably supported within bores 98 formed in the cam carrier 13. An exhaust camshaft 99 is rotatably journaled within the cam carrier 13 and has cam lobes 101 that engage the thimble tappets 97 for opening the exhaust valves 85.

The intake and exhaust camshafts 46 and 99 are driven by any suitable cam driving mechanism at one-half crankshaft speed, as is well known in this art. The upper end of the cam carrier 13 is closed by a cover plate 102 that is detachably affixed thereto in a known manner.

Figure 7:
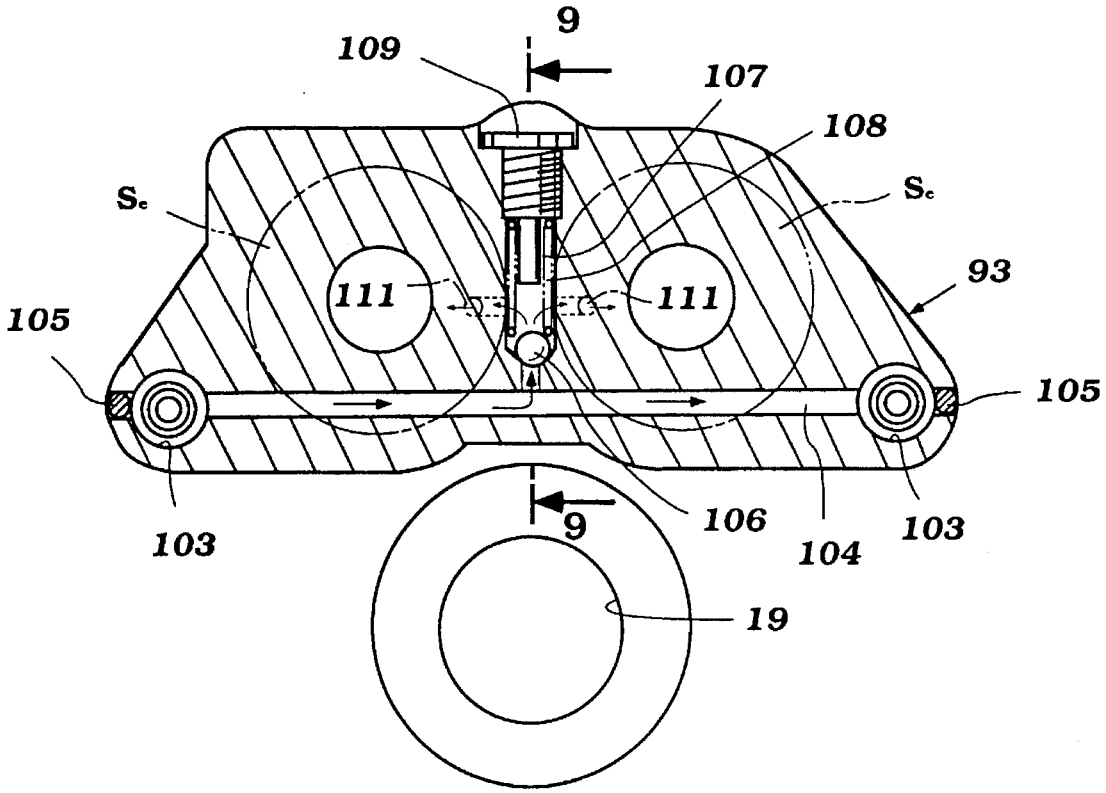
FIG. 7 is an enlarged cross-sectional view taken along the line 7—7 of FIG. 2.

The construction of the air spring arrangement for the exhaust valves 85 will now be described by particular reference to FIGS. 7–9. Referring first to FIGS. 7 and 9, the insert piece 93 is provided with a pair of through drillings 103, one of which is supplied with air under pressure from passages formed in the cylinder head 12 similar to the supply of air to the intake valve insert piece 33. These drillings 103 are intersected by a cross drilling 104 that has its outer ends closed by closure plugs 105. This cross drilling 104 extends beneath the chambers $S_e$ at one side thereof, and particularly on the side adjacent the spark plug well 194. Air pressure is delivered from the passage 104 to the bores 94 at the lower end thereof through a pressure responsive valve assembly, including a ball type valve 106 that is provided in a counterbore 107 at the juncture between a smaller diameter portion that cooperates with the drilling 104 and a larger diameter portion in which a spring 108 is received. The spring 108 is loaded by an adjustable stop 109 so as to control the pressure at which the ball check valve 106 will open. A pair of passages 111 are drilled from the base of the bores 94 to intersect the counterbore 107 and permit air to flow under pressure to the chambers $S_e$.

Figure 8:
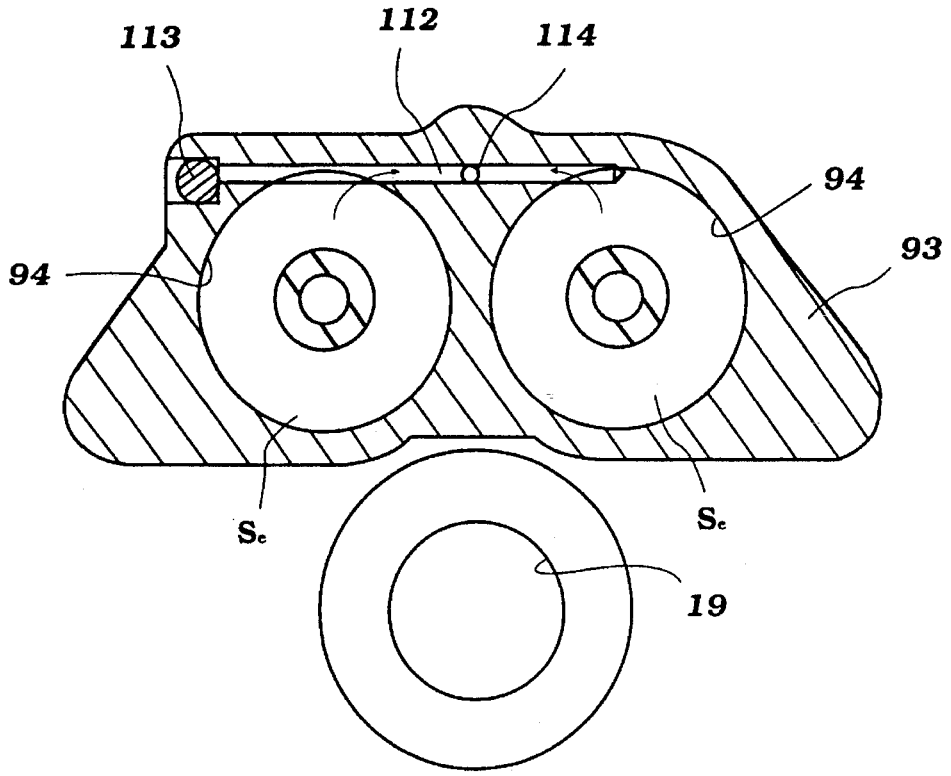
FIG. 8 is an enlarged cross-sectional view taken along the line 8—8 of FIG. 2.
Figure 9:
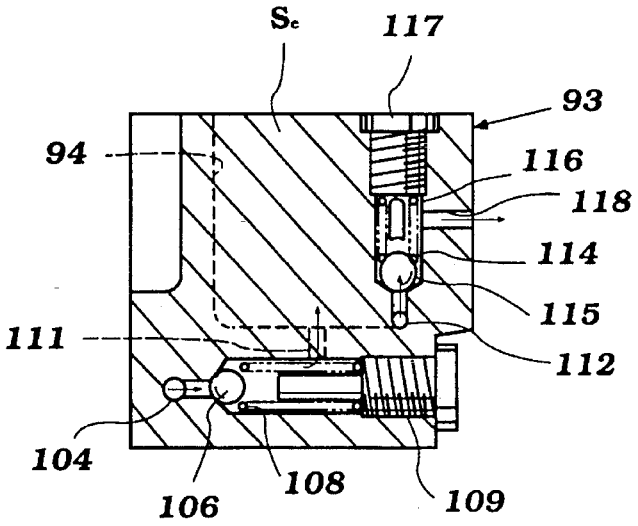
FIG. 9 is the cross-sectional view taken along the line 9—9 of FIG. 7.

The maximum pressure in the exhaust valve air spring chambers Se is controlled by a pressure relief arrangement, as shown in FIGS. 8 and 9. This includes a cross drilling 112 that is closed at its outer end by a plug 113 and which intersects the bores 94 adjacent their lower ends. The drilling 112 is intersected by a counterbore 114 (FIG. 9). A ball type check valve 115 controls a valve seat formed between its smallest diameter and next diameter portions. A coil compression spring 116 is loaded by an adjustable screw 117 so as to set the pressure at which the ball type check valve 115 is opened. When this pressure is exceeded, the ball check valve 115 will open, and excess pressure can be relieved through an atmospheric dump 117 that intersects the portion of the counterbore in which the spring 114 is received.

Figure 10:
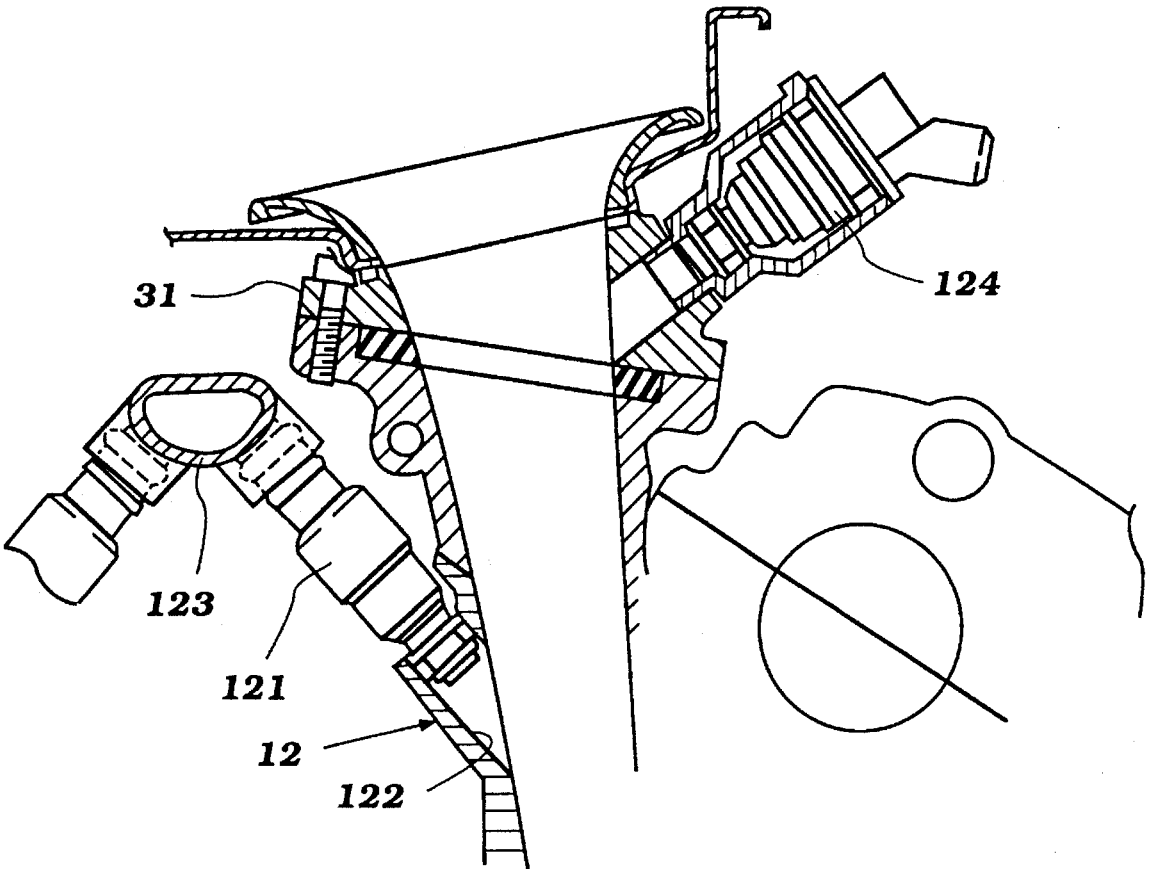
FIG. 10 is a cross-sectional view taken along a plane parallel to the planes of FIGS. 1 and 2 and shows the arrangement of the fuel injectors in the induction system.

As has been noted, a system is provided for forming a charge in the intake passages 29, and FIG. 10 shows a type of fuel injection system that may be employed in conjunction with such an arrangement. This fuel injection system includes a two-stage injector arrangement that is comprised of a lower fuel injector, indicated generally by the reference numeral 121, that is mounted in a recess 122 of the cylinder head 12 and which intersects at least one of the intake passages 29. This fuel injector 121 is supplied with fuel by a fuel rail 123.

In addition, there is an upper side feed-type fuel injector 124 that is mounted in the trumpet assembly 31 and which receives fuel in a suitable manner from a fuel rail or the like. The injector 124 extends more horizontally, and thus permits a low overall height for the engine while ensuring adequate fuel supply for it.

It should be readily apparent that the described construction permits the use of three intake valves for a given cylinder of an engine which need not be aligned with each other. By providing the separate insert piece in which the air springs are formed, it is possible to suitably form the supply and discharge air passages for these air springs and permit a compact assembly without interference with the other passages and ports formed in the main cylinder head. Although the construction is described in conjunction with a three-intake-valve arrangement, it should also be apparent that it can be employed with three exhaust valves. In addition, the concepts of the invention can be employed with a greater number of valves that do not have their axes lying in a common plane. In the illustrated embodiment, there is provided a separate insert piece for the intake valves of each cylinder and for the exhaust valve of each cylinder. Although there are advantages for using such separate insert pieces, all of the air springs for all of the intake valves for a given cylinder bank can be formed by a single insert piece as can all of the air springs for the exhaust valves. In some engines, it also may be possible to employ one insert piece for both the intake and exhaust valves for a single cylinder. Various other changes and modifications may be made without departing from the spirit and scope of the invention as defined by the appended claims.

I claim:

1. An air spring arrangement for the cylinder head of an internal combustion engine having a combustion chamber with a spark plug placed in said cylinder head assembly generally centrally in said combustion chamber, at least three poppet-type valves supported for reciprocation within said cylinder head assembly in surrounding relationship to said spark plug, said air spring arrangement comprising at least three air chambers formed in said cylinder head assembly, each surrounding at least in part a stem of a respective one of said poppet valves, and a V-shaped air passage formed in said cylinder head between said spark plug and said air chambers and communicating with said air chambers.

2. An air spring arrangement as in claim 1, wherein the V-shaped air passage intersects at least one of the air chambers.

3. An air spring arrangement as in claim 2, wherein the V-shaped passage intersects the center air chamber.

4. An air spring arrangement as in claim 3, wherein the V-shaped passage intersects the center air chamber at the bight of the V.

5. An air spring arrangement as in claim 1, wherein the V-shaped air passage communicates with each of the air chambers through respective drilled passages extending transversely to the legs of the V-shaped passage.

6. An air spring arrangement as in claim 5, wherein there are a pair of intersecting passages, each intersecting one leg of the V-shaped passage.

7. An air spring arrangement as in claim 6, wherein each intersecting passage communicates with a pair of adjacent air chambers through corresponding drilled passages.

8. An air spring arrangement as in claim 7, further including pressure responsive valve means for controlling the flow from the intersecting passages to the air chambers.

9. An air spring arrangement as in claim 8, further including a second V-shaped air passage communicating with each of the air chambers for permitting flow from the air chambers.

10. An air spring arrangement as in claim 9, wherein the second V-shaped air passage is vertically spaced from the first V-shaped air passage.

11. An air spring arrangement as in claim 10, further including means for communicating the second V-shaped air passage with each of the air chambers and wherein the center air chamber communicates directly with the V-shaped passage.

12. An air spring arrangement as in claim 11, wherein the second V-shaped air passage intersects the center air chamber at the bight of its V.

13. An air spring arrangement as in claim 1, wherein the center air chamber receives the stem of a poppet valve that reciprocates along a first axis that is disposed at an acute angle to a plane containing the axis of the associated combustion chamber and the remaining air chambers receive the stems of a pair of valves that reciprocate about axes that lie in a common plane that is disposed at a different acute angle to the cylinder axis plane than the stem of the valve in the center air chamber.

14. An air spring arrangement as in claim 1, wherein the cylinder head assembly is comprised of a cylinder head in which the poppet valves are reciprocally supported and which defines a common cavity through which the stems of the three poppet valves extend, an insert piece received in said cavity and defining the air chambers and the V-shaped air passage, and a further cylinder head member affixed to the cylinder head and restraining the insert piece in the recess.

15. An air spring arrangement as in claim 14, wherein the other cylinder head member comprises a cam carrier defining bores slidably supporting tappets engaging the stems of the respective valves for opening the respective valves.

16. An air spring arrangement as in claim 15, wherein the insert piece is formed with a plurality of bores, one for each valve stem, and further including a piston affixed to the respective valve stems below the respective tappet and which piston is slidably supported within a respective one of the insert piece bores to form the air spring.

17. An air spring arrangement as in claim 16, wherein the V-shaped air passage intersects at least one of the air chambers.

18. An air spring arrangement as in claim 17, wherein the V-shaped passage intersects the center air chamber.

19. An air spring arrangement as in claim 18, wherein the V-shaped passage intersects the center air chamber at the bight of the V.

20. An air spring arrangement as in claim 16, wherein the V-shaped air passage communicates with each of the air chambers through respective drilled passages extending transversely to the legs of the V-shaped passage.

21. An air spring arrangement as in claim 20, wherein there are a pair of intersecting passages, each intersecting one leg of the V-shaped passage.

22. An air spring arrangement as in claim 14, wherein the engine is provided with a plurality of cylinders, each of said cylinders having at least three poppet-type valves, the cylinder head having a recess for each cylinder receiving a separate insert piece, each of said insert pieces forming at least three air chambers.

23. A cylinder head assembly for an internal combustion engine comprising a first cylinder head member slidably supporting the stems of at least two poppet type valves, a second cylinder head member detachably affixed to said first cylinder head member, one of said cylinder head members having a recess surrounding said valve stems, and an insert piece retained in said recess between said cylinder head members and defining a pair of bores each receiving a piston affixed to the stem of a respective one of said valves for forming an air spring for urging said valves to their closed positions.

24. A cylinder head assembly as in claim 23, wherein the engine is provided with a plurality of cylinders, each of said cylinders having at least three poppet-type valves, the one cylinder head member having a recess for each cylinder receiving a separate insert piece, each of said insert pieces forming at least three air chambers.

25. A cylinder head assembly as set forth in claim 24 wherein the first cylinder head member defines a combustion chamber with a spark plug placed in said first cylinder head member generally centrally in said combustion chamber, the at least three poppet-type valves being supported for reciprocation within said first cylinder head member in surrounding relationship to said spark plug.

26. A cylinder head assembly as in claim 25, wherein the center air chamber receives the stem of a poppet valve that reciprocates along a first axis that is disposed at an acute angle to a plane containing the axis of the associated combustion chamber and the remaining air chambers receive the stems of a pair of valves that reciprocate about axes that lie in a common plane that is disposed at a different acute angle to the cylinder axis plane that the stem of the valve in the center air chamber.

27. A cylinder head assembly as in claim 26, wherein the second cylinder head member comprises a cam carrier defining bore slidably supporting tappets engaging the stems of the respective valves for opening the respective valves.

28. A cylinder head assembly as in claim 26, wherein the insert piece has a pair of bores at the lower end of the chambers associated with the pair of valves which are complimentary in diameter to the stems of the pair of valves for fitting on to said stems of said pair of valves, the center air chamber being defined at its lower end by a bore that is larger in diameter than the stem of the center poppet valve.

29. A cylinder head assembly as in claim 28, wherein each of the poppet valves is supported for reciprocation in the cylinder head by a respective valve guides and wherein the valve guides extend into the cylinder head recess, the air chambers associated with the pair of valves having a counter bore at the base of the bore that surrounds the stems of the valves which counter bore is complimentary in diameter to the extending portion of the valve guides that reciprocally support the pair of valves, the center air chamber further being provided with a counter bore below the bore that passes the stem of the center valve and which counter bore is larger in diameter than the extending portion of the valve guide that reciprocally supports the center poppet valve.

* * * * *

UNITED STATES PATENT AND TRADEMARK OFFICE
CERTIFICATE OF CORRECTION

PATENT NO. : 5,553,572

DATED : September 10,1996

INVENTOR(S) : Katsumi Ochiai

It is certified that error appears in the above-identified patent and that said Letters Patent is hereby corrected as shown below:

On the title page, item [57]
Assignee should be -- YAMAHA HATSUDOKI KABUSHIKI KAISHA --.

Attorney, Agent, or Firm - delete Pasquale Musacchio; Jerry A Miller and insert --Knobbe, Martens, Olson & Bear--

Signed and Sealed this

Seventh Day of April, 1998

Bruce Lehman

*Attest:*

BRUCE LEHMAN

*Attesting Officer*

*Commissioner of Patents and Trademarks*